US005603638A

United States Patent [19]

Brown et al.

[11] Patent Number: 5,603,638

[45] Date of Patent: Feb. 18, 1997

[54] HOUSING FOR FEMALE RECEPTACLES IN A MOLDED PLUG

[75] Inventors: Donald C. Brown, Freehold; Suzanne V. Hickey, Brick; Yook K. Chan, South Amboy; Henry F. Skoczylas, Brick; Michael Shulman, Toms River, all of N.J.

[73] Assignee: Heyco Stamped Products, Inc., Toms River, N.J.

[21] Appl. No.: 504,683

[22] Filed: Jul. 20, 1995

[51] Int. Cl.[6] ..... H01R 13/405

[52] U.S. Cl. ..... 439/606; 439/106

[58] Field of Search ..... 439/696, 701, 439/752, 92, 106, 103, 606, 687, 736

[56] References Cited

U.S. PATENT DOCUMENTS

| | | | |
|---|---|---|---|
| 3,500,284 | 5/1968 | Liberman | 439/106 |
| 4,410,225 | 10/1983 | Stoewe et al. | 439/210 |
| 4,907,985 | 3/1990 | Johnsen | 439/369 |
| 5,219,304 | 6/1993 | Lin | 439/696 |
| 5,234,355 | 8/1993 | Sosinski et al. | 439/337 |
| 5,286,225 | 2/1994 | Tsuji | 439/752 |

*Primary Examiner*—Gary F. Paumen
*Assistant Examiner*—T. C. Patel
*Attorney, Agent, or Firm*—Auslander & Thomas

[57] ABSTRACT

A housing for female receptacles in a molded female receptacle plug has a body and cover to receive female receptacle connectors. The housing is a premold for the receptacle plug. Female receptacles may be engaged in the housing and simultaneously crimped to wires in a cord set. The body and cover are interengagable. They can be snap fit or slide fitted together with female receptacle crimp ends on necks extending through the housing safe from mold plastic flashing in molding, when load bars are conventionally engaged into blade openings in the housing. The assembly of the housing and female receptacle is automatable with labor and material economies obtained in the molding and from automatable assembly and simultaneous crimpability of the engaged female receptacles.

27 Claims, 6 Drawing Sheets

FIG.1
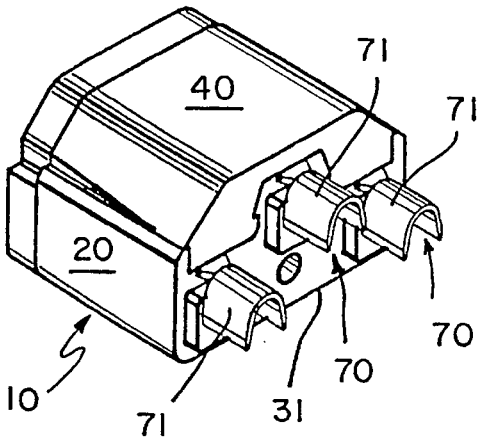
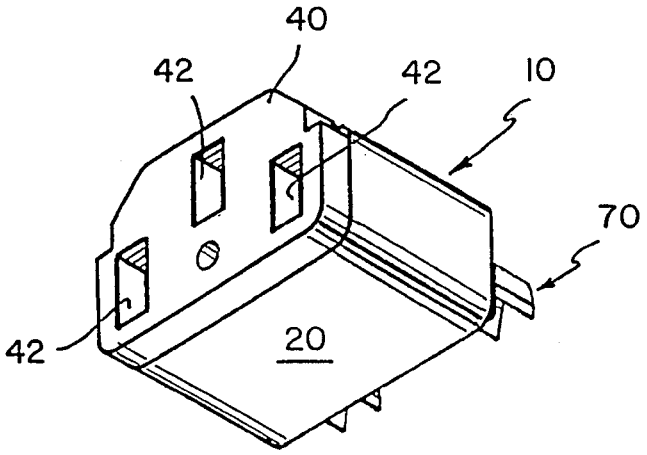
FIG.2

FIG.17
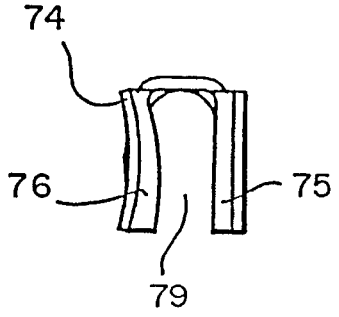
FIG.16
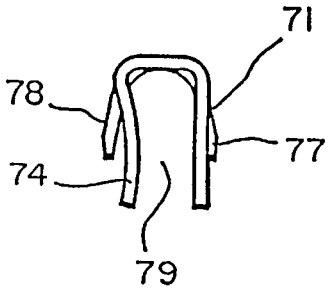
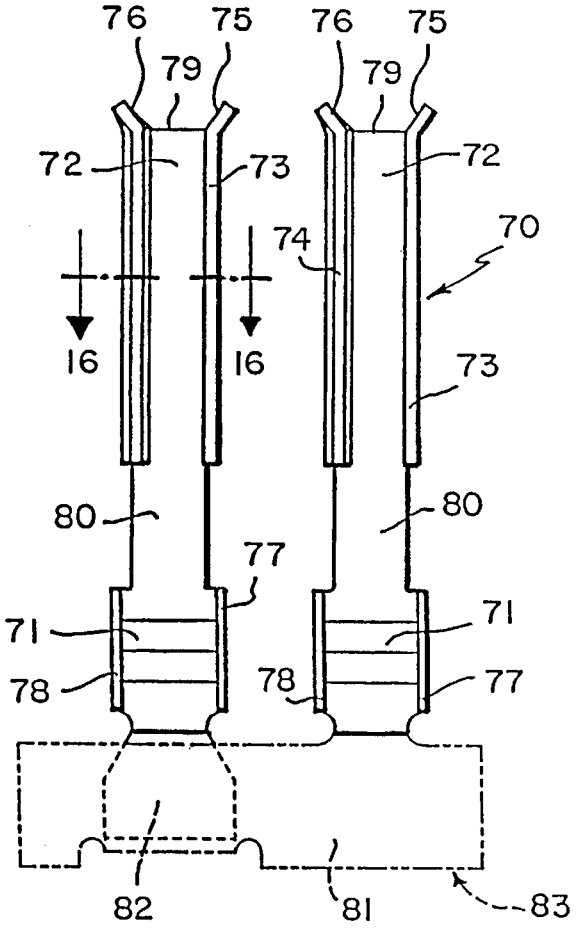
FIG.15
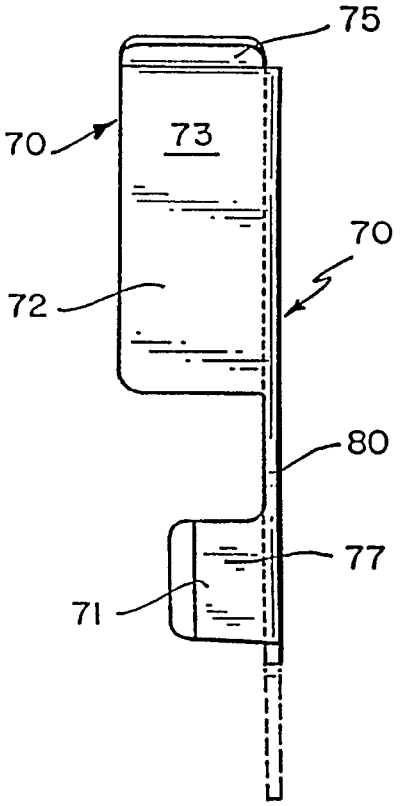
FIG.14

HOUSING FOR FEMALE RECEPTACLES IN A MOLDED PLUG

BACKGROUND OF THE INVENTION

The present invention is a housing usable as a premold for female receptacles in a molded plug.

Some molded plugs for electronic equipment require female receptacles to engage electric contact blades. In computers, particularly the electric contact blades, are oftentimes in groups of three in a triangular relationship. A molded plug, including the female receptacles, is usually molded with three female receptacles. Each receptacle is crimped to a wire in a cord set.

In the past, cord sets were oftentimes machine crimped with conductors such as female receptacles in automated systems. The wires of the cord set were in an automated system, to be crimped to conductors such as a female receptacle, fed from a coil or roll of conductors on the stamping strip.

The cord set crimped to female receptacles, then to be molded within plugs, had to be placed in a mold on load bars to be held in proper position.

Molding of the female receptacles is complex. Three crimped female receptacles have to be positioned in the mold for injection molding, it requires substantial labor, a large volume of plastic must be used in the molding and there is always the risk of wild strands.

By using the housing of the present invention, overmolding cycle time is reduced due to ease of loading the housing into the mold. Overmolding compound requirement is drastically reduced, allowing for an increase in mold cavitation.

A less expensive overmolding compound can be used due to receptacle retention characteristics. Receptacles can be automatically assembled.

The housing allows for the crimping of three contacts in place at once instead of crimping the contacts separately. The housing is flash free, no overmolding compound can get between the contacts, causing discontinuity.

The insertion and withdrawal forces associated with the introduction of the male blades are constant, and do not vary with the overmolding compound durometer, because the contacts extension and compression are determined by its interaction with the housing.

Prior art female business machine contact receptacles, which are overmolded without the housing, may have problems with flashing and also insertion and withdrawal forces due to varying overmolding compound durometers.

The present invention insures proper spacing of female receptacles to each other, allows for automatic assembly where all three terminals are crimped at once, reduces overmolding cycle time and labor due to ease of loading the housing into the mold and reduced plastic requirement.

DESCRIPTION OF THE RELATED ART

Annexed hereto is Form PTO-1449 and copies of the patents and prior art cited therein.

U.S. Pat. No. 3,945,708 discloses a female connector including a premold for emplacing female receptacles in separate compartments. The premold includes a snap in end cover to hold the female receptacles in the premold.

U.S. Pat. No. 4,907,985 is exemplary of a male and female mating ends for a pair of power extension cords. The connection pair is in triangular form, or may be semicircular or rectangular.

It is respectfully requested that this citation of art be made of record with regard to the within application.

SUMMARY OF THE INVENTION

In a preferred embodiment of the present invention, a premold housing comprising a body and a cover to receive the female receptacles. A particular advantage of the present invention is that the premold can receive female receptacles before they are crimped. The female receptacles may be hopper feedable into the body of the premold or loaded by severing from a stamping strip.

The loaded body with female receptacles is capped with a cover. Then the automated crimping of wires from a cord set to the female receptacles in the premold may be done.

Basic advantages of the present invention are the speed and economy of assembly of the female receptacles in the premold housing, which is automatable, the ability to crimp cord set wires to the female receptacles in the premold, the ease of handling the assembled premold, the economy of saving molding plastic in the molding process, or being able to use less expensive overmolding plastic and the improved electrical integrity of a resulting molded plug.

The present invention eliminates the prior art necessity of individual crimping of wires and has the advantage of being more easily managed.

Molding can be prepared in a shorter time, using less molding material.

According to the present invention, a flash free premold housing for female receptacles molded into a plastic molded multi-opening female receptacle plug has a housing having an interengagable molded body and molded cover, to receive three female receptacles. The female receptacles have a receiving portion a neck and a crimp end. The housing has a body, a cover, and three cavities defined by the body and cover. The body has three cavity portions, a front portion, a rear portion and interengagable grasping means to interactively grasp the cover. The cover has a top portion and a flange portion, an inner facing portion for each cavity, a rear portion, and interengagable grasping means to interactively grasp the body. Each body cavity portion has an open top part, a rear part, and an open front part. The flange portion of the cover extends substantially perpendicular with regard to its top portion and has three blade openings. The three cavities are in a triangular configuration, with one blade opening addressed to each cavity open front part, and one the inner facing portion of the cover forming a top with one cavity open top part. The body and cover have means at each cavity rear part through the respective body and cover rear portions to accept the female receptacle extending neck portion which has a crimp end extending through the housing formed by the closely interengaged body and cover impervious to molding plastic flashing. The body and cover can define a cavity forming an apex of the triangular configuration and the part of the grasping means may be adjacent the apex cavity. The grasping means may be snap engagable and have a detent and an inset which may be longitudinal in the housing. Snap engaging means may have a bearing surface and a mating surface. The housing may have external means between the body and cover, to non slideably interengage the snap engaged body, and cover and may include interactive edges and protrusions. There may be support means within a cavity and a through hole in the housing apart from any cavity.

The detent and inset may be longitudinal in the housing and have a bearing surface and a mating surface.

There may be a flash free premold housing for female receptacles molded into a plastic molded multi-opening female receptacle plug with a housing having an interengagable molded body and molded cover to receive at least two the female receptacles. The female receptacle have a receiving portion, a neck and a crimp end. The housing has a body, a cover, at least two cavities defined by the body and the cover. The body has at least two cavity portions, a front portion, a rear portion, and interengagable grasping means to interactively grasp the cover. The cover has a top portion and a flange portion, an inner facing portion for each cavity, a rear portion, and interengagable grasping means to interactively grasp the body. Each body cavity portion has an open top part, a rear part, and an open front part. The flange portion of the cover extends substantially perpendicular with regard to its top portion and has at least two blade openings, with one blade opening addressed to one cavity open front part and one inner facing portion of the cover, to form a top with an open top part. The body and cover have means at each cavity rear part through the respective body and cover rear portions to accept the female receptacle extending neck portion, having a crimp end extending through the housing formed by the closely interengaged body and cover, impervious to molding plastic flashing.

A part of the grasping means may be adjacent a cavity. The grasping means may be snap engagable and have a detent and an inset which may be longitudinal in the housing. The snap engagable means may have a bearing surface and a mating surface.

The housing may have external means between the body and the cover to non slideably interengage the snap engaged body and the cover. These means may include interactive edges and protrusions.

There may be support means within a cavity and a through hole in the housing apart from any cavity.

The detent and inset may be longitudinal in the housing and have a bearing surface and a mating surface.

There may be a flash free premold housing for female receptacles molded into a plastic molded multi-opening female receptacle plug having a housing including an interengagable molded body and molded cover to receive at least three female receptacles. The female receptacles have a a receiving portion a neck and a crimp end. The housing has a body, a cover and three cavities defined by the body and cover, in a triangular configuration. The body and cover have interengagable grasping means. There are blade opening means in the cover. Each cavity has a front part and a rear part. The blade opening means are addressed to the cavity front part. The body and cover have means at each cavity rear part through the respective body and cover rear portions to accept the female receptacle extending neck portion which has a crimp end, extending through the housing, formed by the closely interengaged body and cover impervious to molding plastic flashing.

There may be a flash free premold housing for female receptacles molded into a plastic molded multi-opening female receptacle plug having a housing with an interengagable molded body and molded cover to receive three female receptacles. The female receptacles have a receiving portion, a neck and a crimp end. The housing has a body, a cover and three cavities defined by the body and cover. The body has three cavity portions, a front portion, a rear portion, and interengagable grasping means to interactively grasp the cover. The cover has a top portion and a flange portion, an inner facing portion for each cavity, a rear portion and interengagable grasping means to interactively grasp the body. Each body cavity portion has an open top part, a rear part, and an open front part. The flange portion of the cover extends substantially perpendicular with regard to its top portion and has three blade openings. The three cavities are in a triangular configuration. One cavity forms an apex of the configuration. The body and cover grasping means have a detent and inset. The detent and inset are longitudinal in the housing. The body and cover grasping means are adjacent the apex cavity, with one blade opening addressed to each cavity open front part and one the inner facing portion of the cover forming a top with one cavity open top part. The body and cover have means at each cavity rear part through the respective body and cover rear portions, to accept the female receptacle extending neck portion, which has a crimp end extending through the housing formed by the closely interengaged body and cover impervious to molding plastic flashing.

Although such novel feature or features believed to be characteristic of the invention are pointed out in the claims, the invention and the manner in which it may be carried, may be further understood by reference to the description following and the accompanying drawing.

BRIEF DESCRIPTION OF THE DRAWING

FIG. 1 is a rear isometric view of the premold housing with female receptacles engaged, the body and cover interlocked.

FIG. 2 is a front isometric view of FIG. 1 from the bottom.

FIG. 14 is a side elevation of receptacle on a stamping strip end, which is shown in phantom.

FIG. 15 is a top plan view of FIG. 14, showing two receptacles on a stamping strip end, which is shown in phantom.

FIG. 16 is a section of one receptacle of FIG. 14 at lines 16—16.

FIG. 17 is an end elevation of one blade receptacle of FIG. 15

Referring now to the figures in greater detail, where like reference numbers denote like parts in the various figures.

DESCRIPTION OF THE PREFERRED EMBODIMENTS

Figure 5:
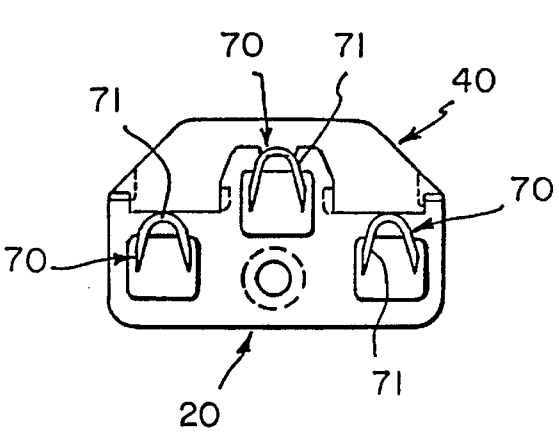
FIG. 5 is a rear side elevation of view FIG. 3.

In FIGS. 1–5 the housing 10, acting as a premold, is shown with a body 20 and a cover 40. Within the housing 10 are female receptacles 70.

As can best be seen in FIGS. 6–9, the body 20 has a first cavity 21, second cavity 22 and a third cavity 23. There are rear cutouts 24 and extending edges 25. The second cavity 22 is elevated, has longitudinal bearing surfaces 26 and longitudinal insets 27. The ends of the cavities 21–23 have notches 28, 29 and 30.

The rear portion 31 includes wire stops 32–34. Each cavity 1–23 includes a pair of receptacle supports 30. The rear portion 31 has a central opening 36 which opens to a central cavity 37 below cavity 22.

The cover 40 has a face 41 with blade openings 42. The cover 40 has a top 43 with side bevels 44. The cover 40 has insets 45 and end protrusions 46. A small opening 49 on the face 41 is juxtaposable with the larger central cavity 37 of the body 20. The small opening 49 is substantially the same size as the central opening 36 in the rear portion 31.

Figure 4:
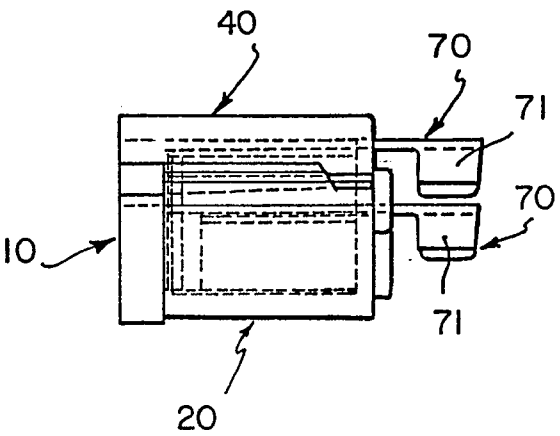
FIG. 4 is a right side elevation view of FIG. 3.
Figure 3:
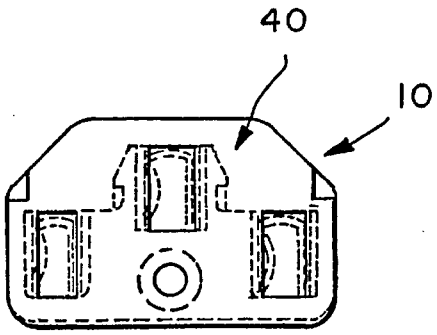
FIG. 3 is a front elevation view of FIG. 1.
Figure 9:
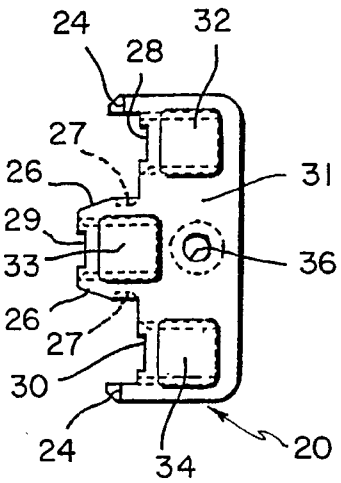
FIG. 9 is a right side elevation view of FIG. 6.
Figure 6:
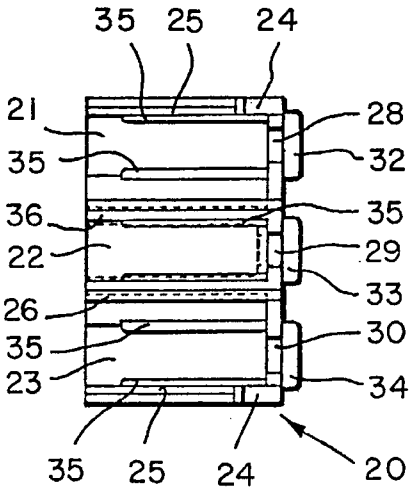
FIG. 6 top plan view of the body of the premold of FIG. 1.
Figure 7:
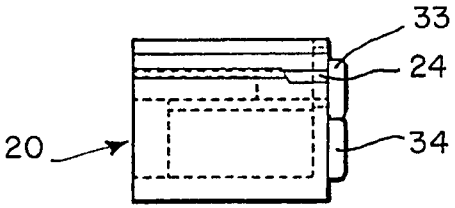
FIG. 7 is an end elevation view of FIG. 6.
Figure 8:
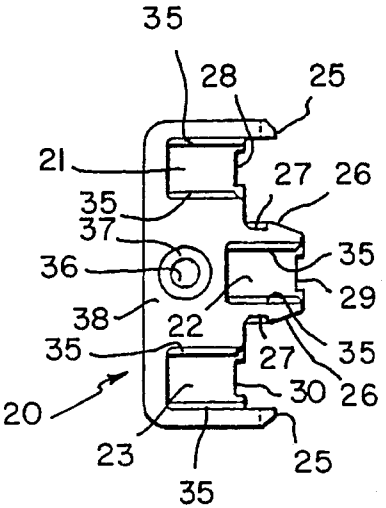
FIG. 8 is a left side elevation view of FIG. 6.
Figure 13:
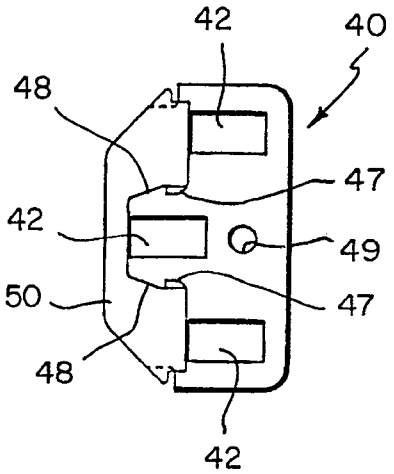
FIG. 13 is a right side elevation view of FIG. 10.

The premold, as shown in FIGS. 3–5, has female receptacles 70 engaged in the cavities 21–23. In a preferred embodiment female receptacles 70 as shown in FIGS. 14–16 are engaged in the cavities 21–23.

The female receptacle 70, as seen in FIGS. 14–17, has a crimp end 71 and a receptacle portion 72. The receptacle portion 72 comprises a flat side 73 and a curved side 74. The receptacle portion 72 has a flared lip guide 76 on the curved side 74 and a flared guide lip 75 on the flat side 73. The crimp end 71 includes crimp arms 77 and 78. The flat side 73 and curved side 74 define an opening 79 to receive a blade. As can be seen in FIGS. 14 and 15, the blade receptacle 70 is on a stamping strip end 81, shown in phantom on a stamping strip 83.

In FIG. 15, the blade receptacles 70 are stamped on the stamping strip 81, as shown in phantom, alternately folded over in parallel alignment, with the next female receptacle 70, folded over and including a folding strip 82, shown in phantom.

Figure 18:
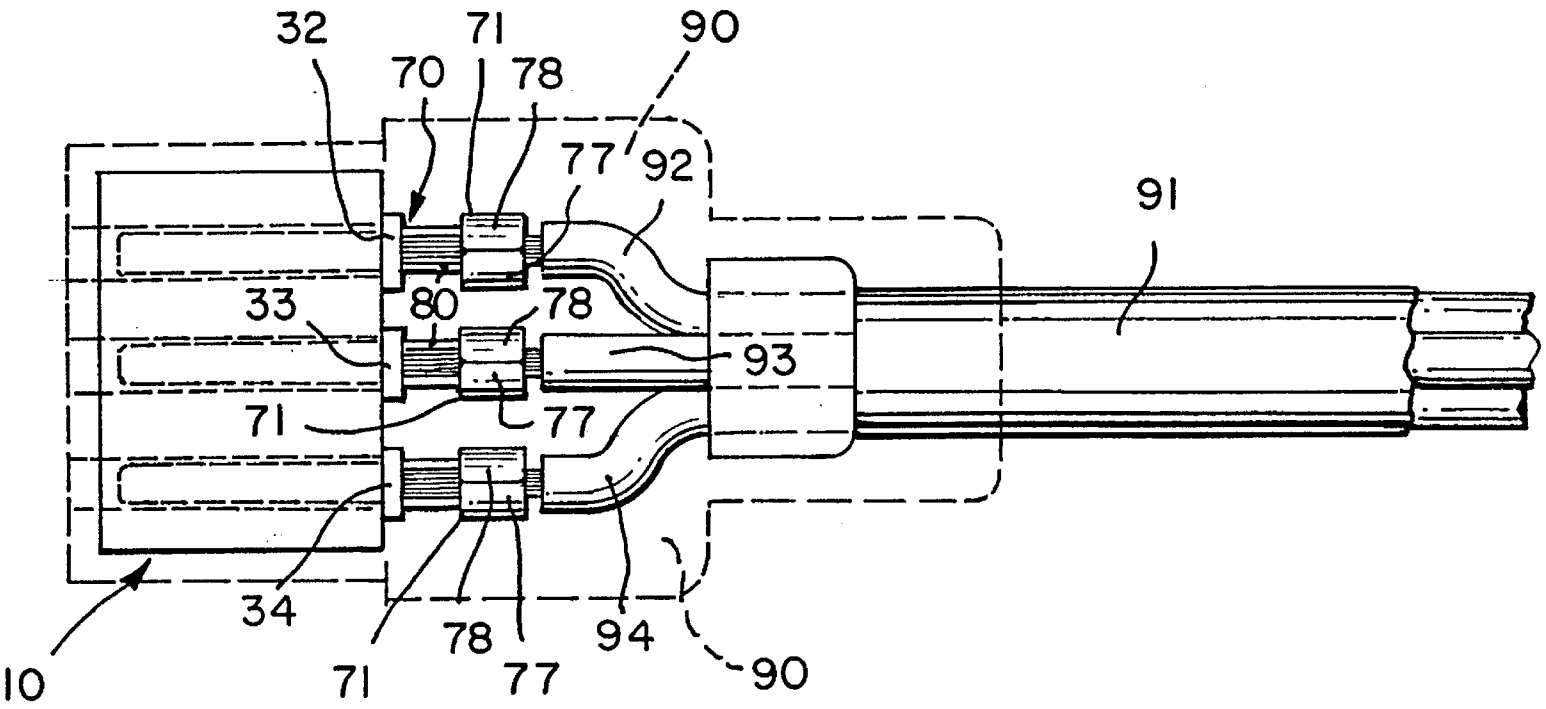
FIG. 18 is a bottom plan view of the premold housing of FIG. 1 molded into a plug with wires crimped, the plug shown in phantom.

FIG. 18 shows a housing 10 of the present invention with female receptacles 70 engaged in a plug-in receptacle 90. A cord 91 with three wires 92–94 has individual wires 92, 93, or 94 crimped to the crimp ends 71 on the crimp arms 77-78.

OPERATION

As shown in FIGS. 1 and 2, the housing 10 of the present invention, has female receptacles 70 engaged in the housing 10 between the cover 40 and the body 20. The crimp ends 71 extend from the rear portion 31 of the body 20. When thus engaged, it can be seen that the blade openings 42 are in a triangular configuration in the housing 10.

The crimp arms 77, 78 on the crimp ends 71, as shown in the figures, are all facing in the same direction. The direction is selected to accommodate simultaneous automated crimping of the wires 92–94 of the cord 91.

The openings 79 of the female receptacles 70 are addressed to the blade openings 42, so when the housing 10 with the female receptacle 70 is molded into a receptacle 90, as shown in FIG. 18, a male blade (not shown), thus enters through the openings (not shown) of the receptacle 90 and is guided into the blade openings 42 of the cover 40.

The flared lips 75, 76 further guide the blades so that the male blades are engaged with full surface contact of the flat side 73.

The female receptacle 70 disclosed in FIGS. 14–16, is the subject matter of copending application Ser. No. 08/389,946, entitled Blade Receptacle. The female receptacle 70 is the preferred embodiment of receptacle with regard to the present invention.

The female receptacles 70 with crimp ends 71 extend from the housing 10 with openings 79 addressed to the blade openings 42.

A utility of the housing 10 of the present invention, is that receptacles 70 engaged in a housing 10 are adapted for simultaneous crimping of the wires 92 to the crimp ends 71, thus effecting additional cost saving in the molding of plugs.

As can be seen in FIGS. 3–5 and 6–9, the portion between the crimp end 71 and the flat side 73 and curved side 74, is flush and engages in one of the notches 28–30. Thus, the engaged female receptacle 70, with its receptacle portion 72 in a cavity 21–23 and its crimp end 71, with crimp arms 77 and 78 extending, are fully engaged in the notches 28–30, so that in any molding process, there could be no flashing into the housing 10.

The intimate fitting of the cover 40, with the body 20, in a molding process, molding the receptacle 90, does not allow any flashing, since in the molding process, the blade openings 42 are engaged on load bars (not shown). The particular advantage of the premold of the present invention, when used with a female receptacle 70, is that the electrical integrity of the full surface connection on one side of a contact blade insures the electrical integrity of the receptacle 90 with its female receptacles 70.

The female receptacles 70 may be automatically insertable into bodies 20 with automation of the snap engagement of the covers 40.

The triangulated positioning of cavity 22 raises the cavity 22 so that the female receptacles 70 are spaced to engage conventional business machine electrical male blade terminals (not shown). The raised cavity 22 allows the longitudinally extending bearing surfaces 26 and insets 27 to serve as a snap fitting, to engage with the longitudinal detents 47 and the longitudinal mating surfaces 48, so that the cover 40 can be snap fit into position in locking integrity.

In the molding process all that need be done is to insert load bars into the receptacle portion 72 of the receptacles 70, engaged in the housing 10 once the wires 92–94 of the cord set 91 have been crimped in order to mold the receptacle 90.

The housing 10 of the present invention is usable in the automated crimping of the female receptacle 70. Thus, the wires 92–94 may be automatably insertable within the crimp arms 77, 78, once the female receptacles 70 have been placed in the housing 10. The wires 92–94 may be simultaneously crimped at the crimp end 71. As can be seen in FIG. 18, the wires 92, 93, as crimped, abut the wire stops 32–34, which are on the rear portion 31 of the body 20.

In molding, the cover 40 is manually, or automatably snap engaged with the body 20. When the cover 40 is pushed against the body 20, the resilient detents 47 ride over the bearing surfaces 26 until the detents 47 engage in the insets 27. When the cover 40 and body 20 are engaged, the bearing surfaces 26 and mating surfaces 48 are snugly engaged along their length so that in molding, there can be no flashing.

When snapping together the cover 40 of the body 20, the face 41 serves as a guide and a stop mechanism against further movement of the cover 40 and body 20 in relation to each other. The extending edges 25 of the body 20 resiliently engage in the inset 45 of the cover 40. The protrusions 46 also engage themselves with the rear cutouts 24. Thus, once snap engaged, the body 20 and cover 40 act as a unitary housing and in molding, allow no flashing to interfere with the functioning of the female receptacles 70.

As can be seen in FIG. 5, the cover 40 and body 20 are intimately engaged at their ends in a snug manner, to prevent flashing. The crimp end 71 is separated from the receptacle portion 72 of the female receptacle 70 by a neck 80. The necks 80 of the female receptacles 70 intimately engage in the notches 29, 30, so that no flashing can enter the cavities 21–23.

Receptacle supports 35 in the cavities 21–23, retain the female receptacles 70 against free movement within the cavities 21–23.

In molding, plastic is flowable through the opening 36 of the body 20 and opening 49 of the cover 40, filling the greater diameter cavity 37 in the body 20 with plastic, sealing the housing 10 against separation and providing homogenous molding of the housing 10 within the receptacle 90.

Although the preferred embodiment, as shown in the specification, discloses the female receptacles 70, it is contemplated that other female receptacles, intimately engagable through the wall created by the rear portion 50 of the cover 40 and the rear portion 31 of the body 20 are usable with the present housing 10, as long as they fit within the cavities 1–23 and have necks that extend through the rear portion 31 without providing openings for flashing to enter the housing during the molding process.

Figure 10:
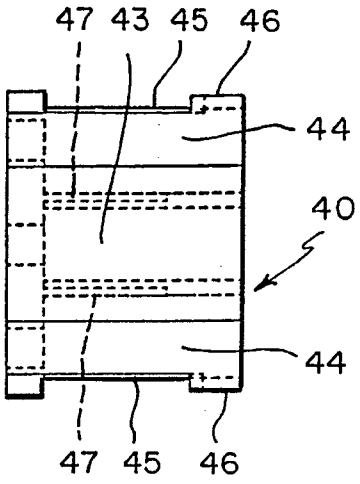
FIG. 10 top plan view of the cover of the premold of FIG. 1.
Figure 11:
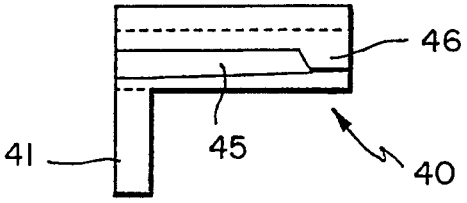
FIG. 11 is an end elevation view of FIG. 10.
Figure 12:
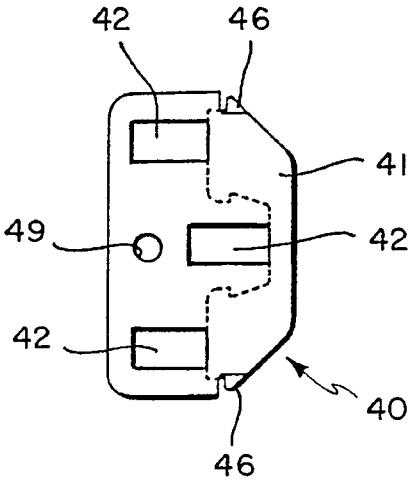
FIG. 12 is a left side elevation view of FIG. 10.

As can be seen in FIG. 10, the longitudinally extending detent 47 does not have to extend the full length of the cover 40.

The stopping interengagement of the cover 40 in the body 20 with the interaction of the face 41 and protrusion 46, with the extending edges 25 engaging in the insets 45 prevent an intersliding between the cover 40 and the body 20, which is preferable.

In a less preferred embodiment (not shown), there may be sliding engagement, with or without body and cover stopping intergagement.

The interaction between the face 41 and the front portion 38 of the body 20, does provide good integrity when molded into a plug and satisfactory integrity for automated crimping of the female receptacles 70 to the wires 92–94.

Once molded, the plastic through the openings 36 and 49, filling the cavity 37, provides good integrity between the housing 10 and the molded receptacle 90.

The beveling of the cover 20, with its bevels 44, is primarily to accommodate the usual shape of the receptacle 90 in a business machine.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. An overmoldable insulative plastic housing for female electric contact receptacles in a plastic molded multi-opening female receptacle plug and said housing substantially impervious to plug molding plastic flashing and said housing including an interengagable body and cover to receive three female electric contact receptables, each female electric contact receptacle having a male electric contact blade receiving portion, a neck and a crimp end, said body, said cover, three cavities, said cavities defined within said housing by said body and said cover, said body and said cover including three cavity portions, said body including a front portion; a rear portion; and interengagable grasping means to interactively grasp said cover, said cover including a top portion; a flange portion; one inner facing portion for each said cavity; a rear portion; and interengagable grasping means to interactively grasp said cover, said cover including a top portion; a flange portion; one inner facing portion for each said said flange portion of said cover extending substantially perpendicular with regard to said top portion; and including three male electric contact blade openings, said three cavities in a triangular configuration, one said blade opening addressable to one said cavity open front part, one said inner facing portion of said cover to form a top with one said cavity open top part, said body and said cover including means at each said cavity rear part through said respective body and cover rear portions to accept therethrough a female receptacle extending neck portion including a crimp end, and when said respective body and cover grasping means are interengaged said body and said cover and said extending neck are substantially impervious to plug molding plastic flowing therebetween.

2. The invention of claim 1 including cavity support means within at least one said cavity.

3. The invention of claim 1 including a through hole in said housing apart from any cavity.

4. The invention of claim 1 wherein said body and cover define a cavity forming an apex of said triangular configuration.

5. The invention of claim 5 wherein said body and cover define at least part of said interengagable grasping means adjacent said apex cavity.

6. The invention of claim 5 wherein said interengagable grasping means are snap engaging means.

7. The invention of claim 6 wherein said snap engaging means include a detent and an inset.

8. The invention of claim 7 wherein said detent and said inset are longitudinal in said housing.

9. The invention of claim 7 wherein said snap engaging means includes at least one bearing surface and at least one mating surface.

10. The invention of claim 7 wherein said detent and inset are longitudinal in said housing.

11. The invention of claim 10 wherein said snap engaging means includes at least one bearing surface and at least one mating surface.

12. The invention of claim 6 including external means between said body and said cover to non slideably interengage said body and said cover.

13. The invention of claim 12 wherein said means to non slideably interengage include at least interactive edges and protrusions.

14. An overmoldable insulative plastic housing for female electric contact receptacles in a plastic molded multi-opening female receptacle plug and said housing substantially impervious to plug molding plastic flashing and said housing including an interengagable body and a cover to receive at least two female electric contact receptacles each female electric contact receptacle having a male electric contact blade receiving portion a neck and a crimp end, said housing said body, said cover, said at least two cavities, said cavities defined within said housing by said body and said cover, said body and said cover including at least two cavity portions, said body including a front portion; a rear portion; and interengagable grasping means to interactively grasp said cover, said cover including a top portion; a flange portion; one inner facing portion for each said cavity; a rear portion; and interengagable grasping means to interactively grasp said body, each said body cavity portion having an open top part; a rear part; and an open front part, said flange portion of said cover extending substantially perpendicular with regard to said top portion; and including at least two male electric contact blade openings, one said blade opening addressable to one said cavity open front part, one said inner facing portion of said cover to form a top with one said cavity open top part, said body and said cover including means at each said cavity rear part through said respective body and cover rear portions to accept therethrough a female receptacle extending neck portion including a crimp end, and when said respective body and cover grasping means are interengaged said body and said cover and said extending neck are substantially impervious to plug molding plastic flowing therebetween.

15. The invention of claim 14 including support means within at least one said cavity.

16. The invention of claim 14 including a through hold in said housing apart from any cavity.

17. The invention of claim 14 wherein said body and said cover define at least part of said interengagable grasping means adjacent said cavity.

18. The invention of claim 17 wherein said interengagable grasping means are snap engaging means.

19. The invention of claim 18 wherein said snap engaging means include a detent and an inset.

20. The invention of claim 19 wherein said detent and said inset are longitudinal in said housing.

21. The invention of claim 19 wherein said snap engaging means includes at least one bearing surface and at least one mating surface.

22. The invention of claim 19 wherein said detent and inset are longitudinal in said housing.

23. The invention of claim 22 wherein said snap engaging means includes at least one bearing surface and at least one mating surface.

24. The invention of claim 18 including external means between said body and said cover to non slideably interengage said body and said cover.

25. The invention of claim 24 wherein said means to non slideably interengage include at least interactive edges and protrusions.

26. An overmoldable insulative plastic housing for female electric contact receptacles in a plastic molded multi-opening female receptacle plug and said housing substantially impervious to plug molding plastic flashing and said housing including an interengagable body and a cover to receive three female electric contact receptacles, each female electric contact receptacle having a male electric contact blade receiving portion, a neck and a crimp end, said body, said cover, three cavities, said cavities defined within said housing by said body and said cover in a triangular configuration, said cover and said body including interengagable grasping means, male electric contact blade opening means in said body or said cover, each said cavity having a front part and a rear part, said male electric contact blade opening means at each said cavity front part, said body and said cover including means at each said cavity rear part through said respective body and cover rear portions to accept therethrough a female receptacle extending neck portion including a crimp end, and when said respective body and cover grasping means are interengaged said body and said cover and said extending neck are substantially impervious to plug molding plastic flowing therebetween.

27. An overmoldable insulative plastic housing for female electric contact receptacles in a plastic molded multi-opening female receptacle plug and said housing substantially impervious to plug molding plastic flashing and said housing including an interengagable body and a cover to receive three female electric contact receptacles, each female electric contact receptacle having a male electric contact blade receiving portion, a neck and a crimp end, said body, said cover, three cavities, said cavities defined within said housing by said body and said cover, said body and said cover including three cavity portions, said body including a front portion; a rear portion; and interengagable grasping means to interactively grasp said cover, said cover including a top portion; a flange portion; one inner facing portion for each said cavity; a rear portion; and interengagable grasping means to interactively grasp said body, each said cavity having an open top part; a rear part; and an open front part, said flange portion of said cover extending substantially perpendicular with regard to said top portion; and including three male electric contact blade openings, said three cavities in a triangular configuration, one said cavity forming and apex of said configuration, said body and said cover interengagable grasping means including a detent and inset, said detent and inset longitudinal in said housing, said body and said cover interengagable grasping means adjacent said apex cavity, one said blade opening addressable to one said cavity open front part, one said inner facing portion of said cover to form a top with one said cavity open top part, said body and said cover including means at each said cavity rear part through said respective body and cover rear portions to accept therethrough a female receptacle extending neck portion including a crimp end, and when said respective body and cover grasping means are interengaged said body and said cover and said extending neck are substantially impervious to plug molding plastic flowing therebetween.

* * * * *

UNITED STATES PATENT AND TRADEMARK OFFICE

CERTIFICATE OF CORRECTION

PATENT NO. : 5,603,638

DATED : February 18, 1997

INVENTOR(S) : Donald C. Brown, et al

It is certified that error appears in the above-identified patent and that said Letters Patent is hereby corrected as shown below:

Column 5, line 4, after "supports", change "30" to -- 35 --

IN THE CLAIMS

Col. 7,
Claim 1, line 5, after "and" insert -- a --

Col. 8,
Claim 14, line 8, after "portion" insert -- , --

Signed and Sealed this

Twentieth Day of May, 1997

Bruce Lehman

*Attest:*

BRUCE LEHMAN

*Attesting Officer*

*Commissioner of Patents and Trademarks*